US009167896B1

(12) United States Patent
Wu

(10) Patent No.: US 9,167,896 B1
(45) Date of Patent: Oct. 27, 2015

(54) SUPPORTING RACK ASSEMBLY

(71) Applicant: SHUTER ENTERPRISE CO., LTD., Taichung (TW)

(72) Inventor: Yi-Ra Wu, Taichung (TW)

(73) Assignee: Shuter Enterprise Co., Ltd., Taichung (TW)

( * ) Notice: Subject to any disclaimer, the term of this patent is extended or adjusted under 35 U.S.C. 154(b) by 0 days.

(21) Appl. No.: 14/519,289

(22) Filed: Oct. 21, 2014

(51) Int. Cl.

| | |
|---|---|
| ***A47B 47/00*** | (2006.01) |
| ***A47B 57/36*** | (2006.01) |
| ***A47B 96/14*** | (2006.01) |
| ***A47B 57/06*** | (2006.01) |

(52) U.S. Cl.
CPC ..... *A47B 57/36* (2013.01); *A47B 57/06* (2013.01); *A47B 96/1441* (2013.01)

(58) Field of Classification Search
CPC ..... A47B 57/06; A47B 57/16; A47B 57/40; A47B 57/482; A47B 57/36; A47B 47/0058; A47B 47/021; A47B 96/1441
USPC ..... 211/187, 191, 192, 186, 134, 189
See application file for complete search history.

(56) References Cited

U.S. PATENT DOCUMENTS

| | | | | | |
|---|---|---|---|---|---|
| 3,266,635 | A * | 8/1966 | McConnell | 211/191 |
| 3,303,937 | A * | 2/1967 | MCconnell | 211/192 |
| 3,862,691 | A * | 1/1975 | Mori et al. | 211/191 |
| 4,341,486 | A * | 7/1982 | Hammerschlag | 403/252 |
| 4,342,397 | A * | 8/1982 | Halstrick | 211/191 |
| 5,082,388 | A * | 1/1992 | Lauterbach | 403/254 |
| 5,749,481 | A * | 5/1998 | Miller | 211/191 |
| 6,422,399 | B1 * | 7/2002 | Castillo et al. | 211/26 |
| 6,520,355 | B1 * | 2/2003 | Pritchard et al. | 211/187 |
| 6,644,481 | B2 * | 11/2003 | Dean et al. | 211/26 |
| 2005/0103734 | A1 * | 5/2005 | Saltzberg et al. | 211/187 |
| 2006/0144809 | A1 * | 7/2006 | Collins et al. | 211/191 |
| 2007/0062898 | A1 * | 3/2007 | Choi | 211/192 |
| 2011/0272373 | A1 * | 11/2011 | Wojtowicz et al. | 211/134 |

* cited by examiner

*Primary Examiner* — Basil Katcheves
(74) *Attorney, Agent, or Firm* — C. G. Mersereau; Nikolai & Mersereau, P.A.

(57) ABSTRACT

A supporting rack assembly has a frame module, multiple shelf holders and multiple shelf bodies. Each shelf holder has a holder body, a supporting portion, two first inserting plates, two second inserting plates, and two engagement plates. The supporting portion is connected with the holder body. The first inserting plates are connected with an end of the holder body, and the second inserting plates are connected with the other end of the holder body. The first inserting plates and the second inserting plates are inserted into the frame module. The engagement plates are connected with the ends of the holder body. The shelf bodies are mounted on the shelf holders.

6 Claims, 6 Drawing Sheets

SUPPORTING RACK ASSEMBLY

BACKGROUND OF THE INVENTION

1. Field of the Invention

The present invention relates to a rack assembly, and more particularly to a supporting rack assembly having pivotable and positionable shelf holders.

2. Description of Related Art

With reference to FIG. 6, a conventional rack, such as a cabinet, a bookcase, a shoe rack, or a filing cabinet, has two pairs of frame modules 63, multiple shelf bodies 61 and multiple hooks 62. Each frame module 63 has multiple slits 64 formed in and arranged longitudinally on the frame module 63. The hooks 62 are respectively inserted into the slits 64 to be mounted on the frame module 63. Each shelf body 61 is mounted on two of the hooks 62 that are at a same height, such that the shelf bodies 61 can be used for placing objects. Therefore, when the hooks 62 are inserted in slits 64 at another height, a height of the overall shelf body 61 can be altered.

The hooks 62 are inserted into the slits 64 to be mounted on the frame module 63. Therefore, when the hooks 62 are inserted in the slits 64, a vision error may affect a user to mount the hooks 62 on the slits 64 of different frame modules 63 of each pair respectively at different heights. Therefore, the hooks 62 may be positioned at different heights. Furthermore, the hooks 62 may be detached from the slits 64 when the hooks 62 are forced by an external force from objects that are placed on the shelf body 61.

SUMMARY OF THE INVENTION

The main objective of the present invention is to provide a supporting rack assembly to resolve the afore-mentioned problems.

The supporting rack assembly has a frame module, multiple pairs of shelf holders, and multiple shelf bodies.

The frame module has two pairs of frames mounted at an interval, and each pair of frames having two frame bodies. Each frame body has a longitudinal direction and multiple fixing holes formed through the frame body along the longitudinal direction of the frame body.

The pairs of shelf holders are mounted on the pairs of frames and arranged longitudinally, and each shelf holder of each pair of shelf holders has a holder body, a supporting portion, two first inserting plates, two second inserting plates, and two engagement plates. The holder body is elongated and has a bottom. The supporting portion is connected with the bottom of the holder body, wherein a junction between the holder body and the supporting portion is bent. The first inserting plates are connected with an end of the holder body and are respectively inserted into two of the fixing holes of one of the frame bodies, wherein two extension directions of the first inserting plates are same with an extension direction of the holder body. The second inserting plates are connected with another end of the holder body at a position opposite to the first inserting plates, and are respectively inserted into two of the fixing holes of the other frame body of the pair of frames, wherein two extension directions of the second plates are different from the extension direction of the holder body.

The engagement plates are respectively connected with the two ends of the holder body, are respectively inserted into the fixing holes of the frame bodies of the pair of frames, wherein two junctions between the engagement plates and the holder body are bent. Each engagement plate has a protrusion formed on the engagement plate, and the protrusions of the engagement plates extend toward each other. Each protrusion and the holder body are respectively located at two opposite sides of the frame body.

The shelf bodies are respectively mounted on the supporting portions of the pairs of shelf holders.

Other objectives, advantages and novel features of the present invention will become more apparent from the following detailed description when taken in conjunction with the accompanying drawings.

DETAILED DESCRIPTION OF PREFERRED EMBODIMENT

Figure 1:
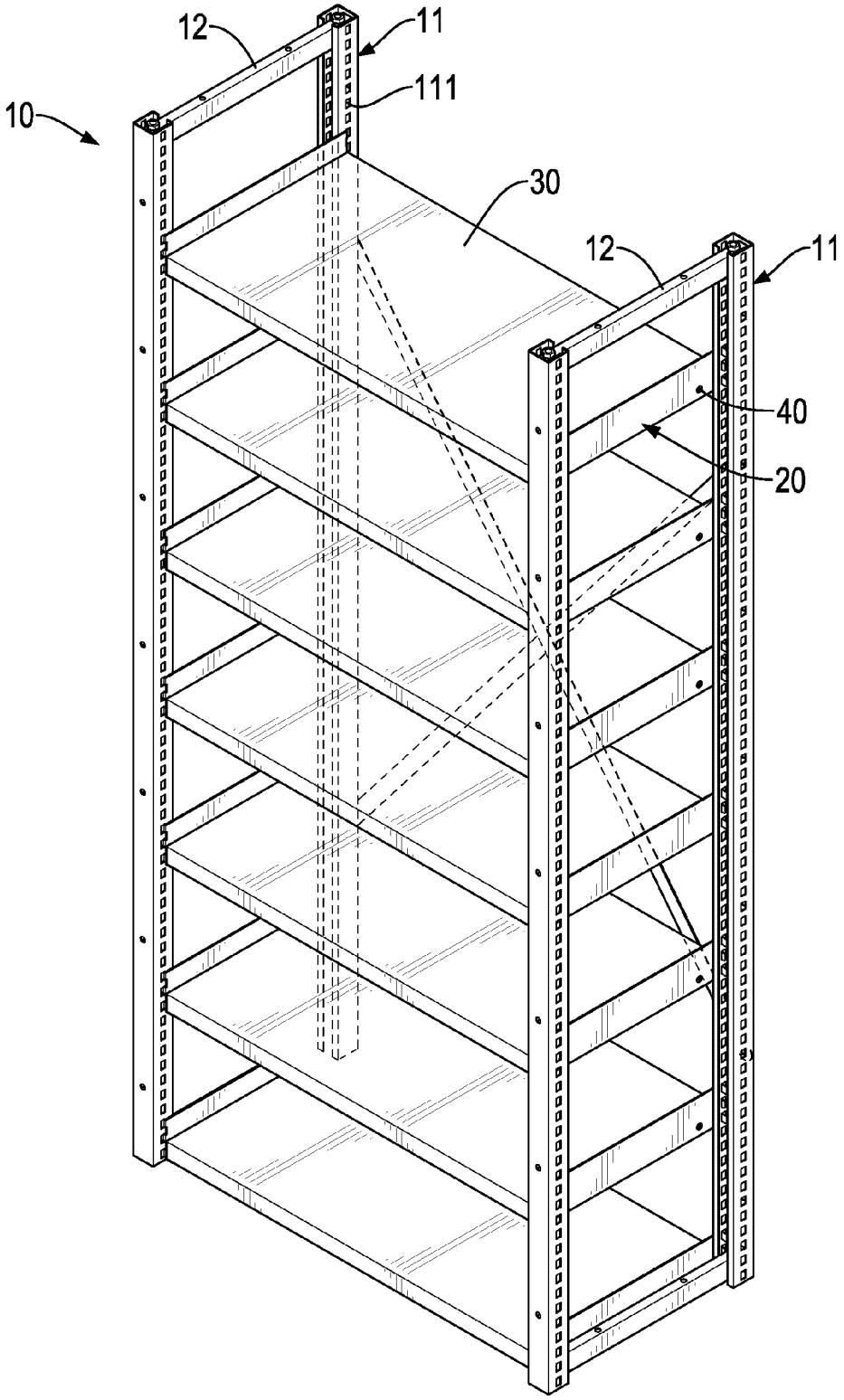
FIG. 1 is a perspective view of a first preferred embodiment of a supporting rack assembly in accordance with the present invention.
Figure 2:
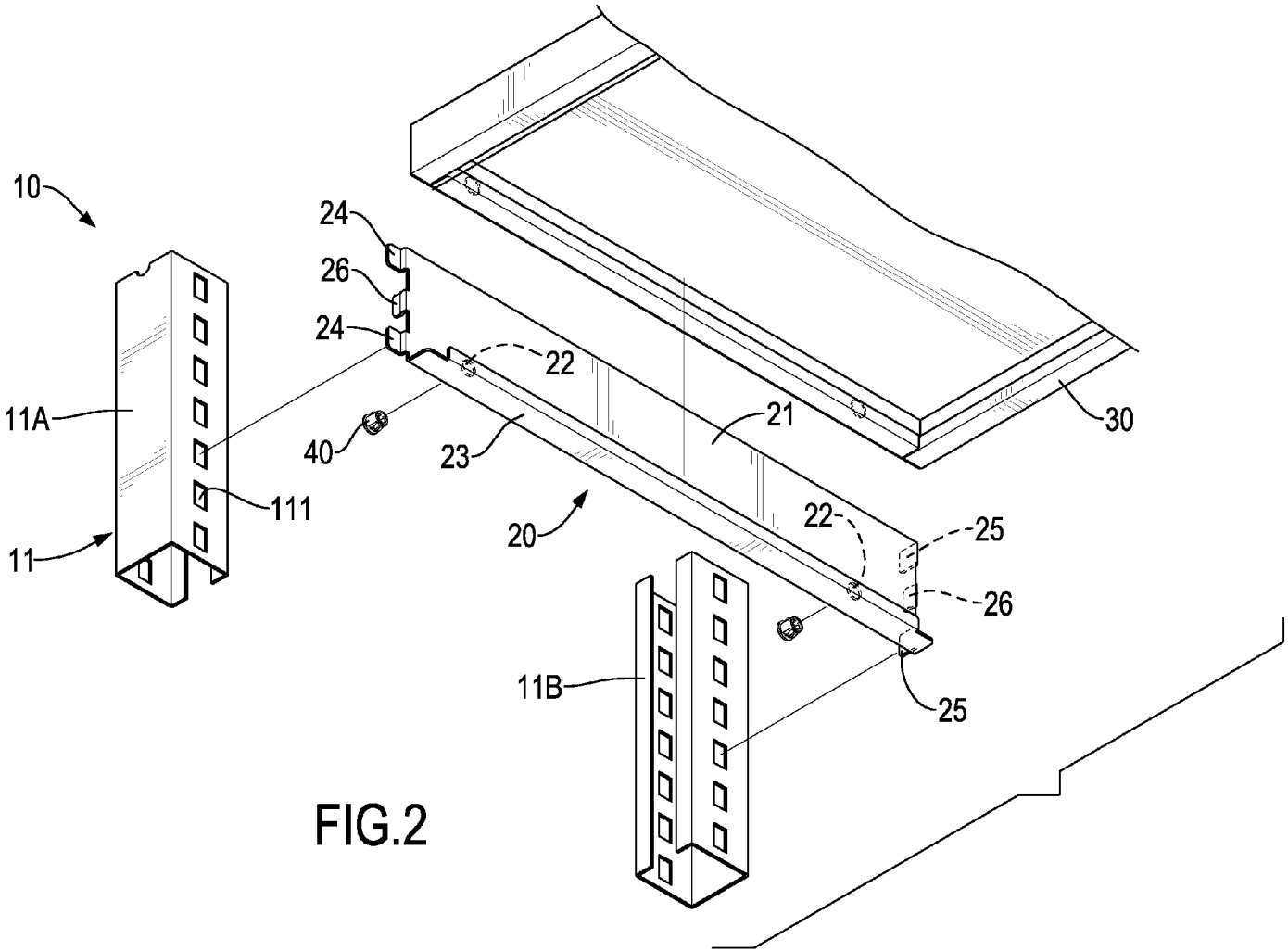
FIG. 2 is an enlarged partially exploded perspective view of the supporting rack assembly in FIG. 1.

With reference to FIGS. 1 to 4, a preferred embodiment of a supporting rack assembly in accordance with the present invention has a frame module 10, multiple pairs of shelf holders 20, multiple shelf bodies 30, and multiple shelf buckles 40.

The frame module 10 has two pairs of frames 11 and two supporting beams 12. The pairs of frames 11 are spaced from each other at an interval. Each pair of frames 11 has two frame bodies 11A, 11B. The supporting beams 12 are respectively mounted in the pairs of frames 11, and each supporting beam 12 is supported between the corresponding frame bodies 11A, 11B to fix the interval between the corresponding frame bodies 11A, 11B. Each frame body 11A, 11B has multiple fixing holes 111 formed through the frame body 11A, 11B and arranged along a longitudinal direction of the frame body 11A, 11B.

The pairs of shelf holders 20 are mounted on the pairs of frames 11 and are arranged longitudinally. Each shelf holder 20 of each pair of shelf holders 20 has a holder body 21, two holder holes 22, a supporting portion 23, two first inserting plates 24, two second inserting plates 25, and two engagement plates 26. The holder body 21 is elongated. The holder holes 22 are formed through the holder body 21. The supporting portion 23 is connected with a bottom of the holder body 21, and a junction between the holder body 21 and the supporting portion 23 is bent. The first inserting plates 24 are connected with an end of the holder body 21, and extension directions of the first inserting plates 24 are same as an extension direction of the holder body 21. The first inserting plates 24 are respectively inserted into two of the fixing holes 111 of the frame body 11A. The second inserting plates 25 are connected with another end of the holder body 21 at a position opposite to the first inserting plates 24. Extension directions of the second plates 25 are perpendicular to the extension direction of the holder body 21. The second inserting plates 25 are respectively inserted into two of the fixing holes 111 of the frame body 11B. The engagement plates 26 are respectively connected with the two ends of the holder body 21, and are respectively located between the first inserting plates 24 and between the second inserting plates 25. The engagement plates 26 are inserted into fixing holes 111 respectively in the frame bodies 11A, 11B. Two junctions between the engagement plates 26 and the holder body 21 are bent. Each engagement plate 26 has a protrusion 261 formed on the engagement plate 26, and the protrusions 261 extend toward each other. Each protrusion 261 and the holder body 21 are respectively located at two opposite sides of the corresponding frame body 11A.

The shelf bodies 30 are respectively mounted on the pairs of shelf holders 20. Two ends of each shelf body 30 are mounted on the supporting portions 23 of the pair of shelf holders 20.

The shelf buckles 40 are buckled on the holder bodies 21 of the shelf holders 20 and the shelf bodies 30 through the holder holes 22, such that the shelf bodies 30 can be fixed on the shelf holders 20.

Figure 3:
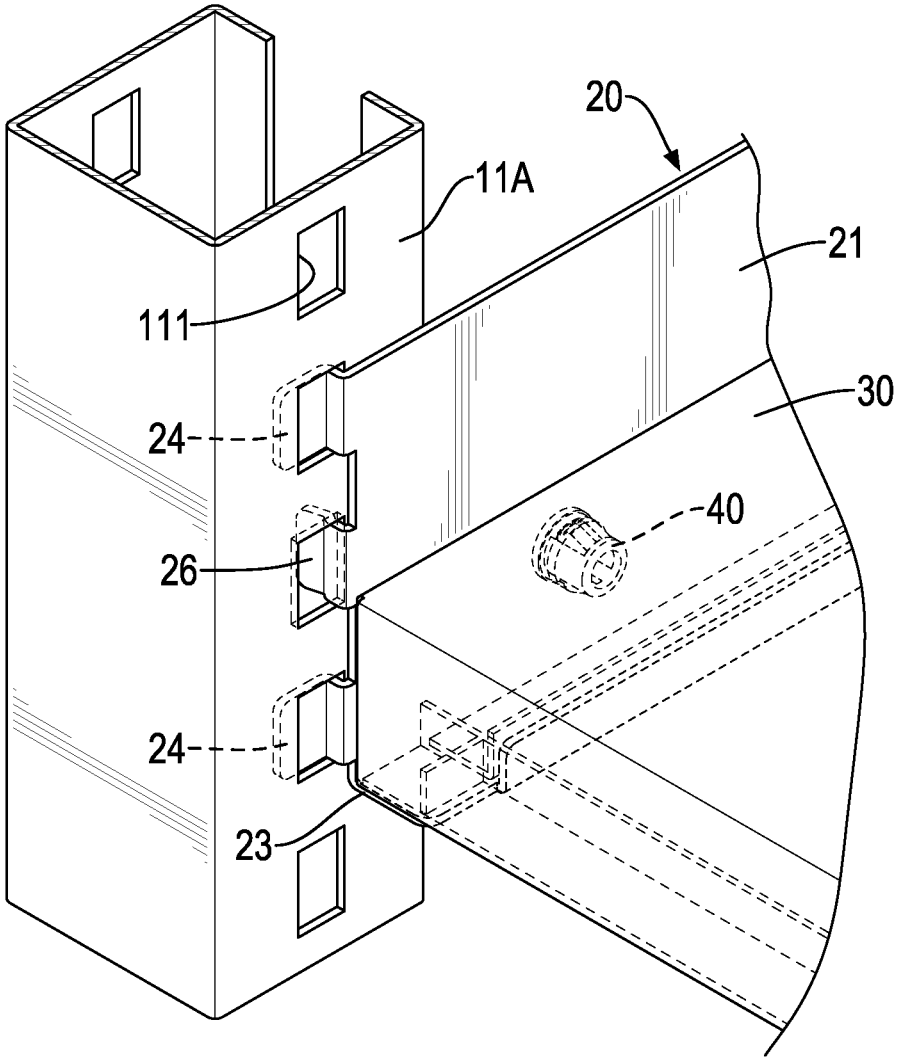
FIG. 3 is an enlarged partial perspective view of the supporting rack assembly in FIG. 1.
Figure 4:
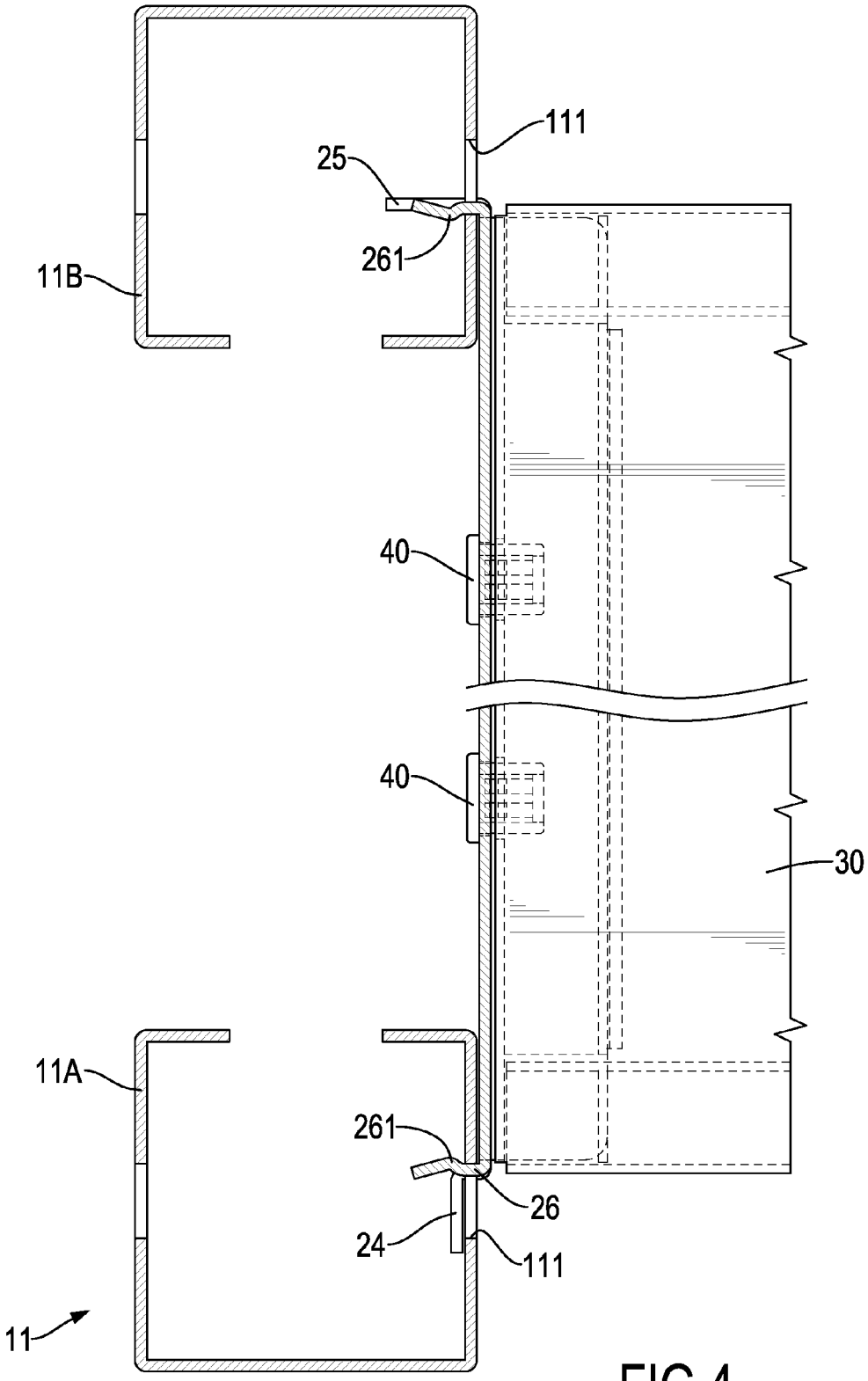
FIG. 4 is an enlarged cross sectional top view of the supporting rack assembly in FIG. 1.
Figure 5:
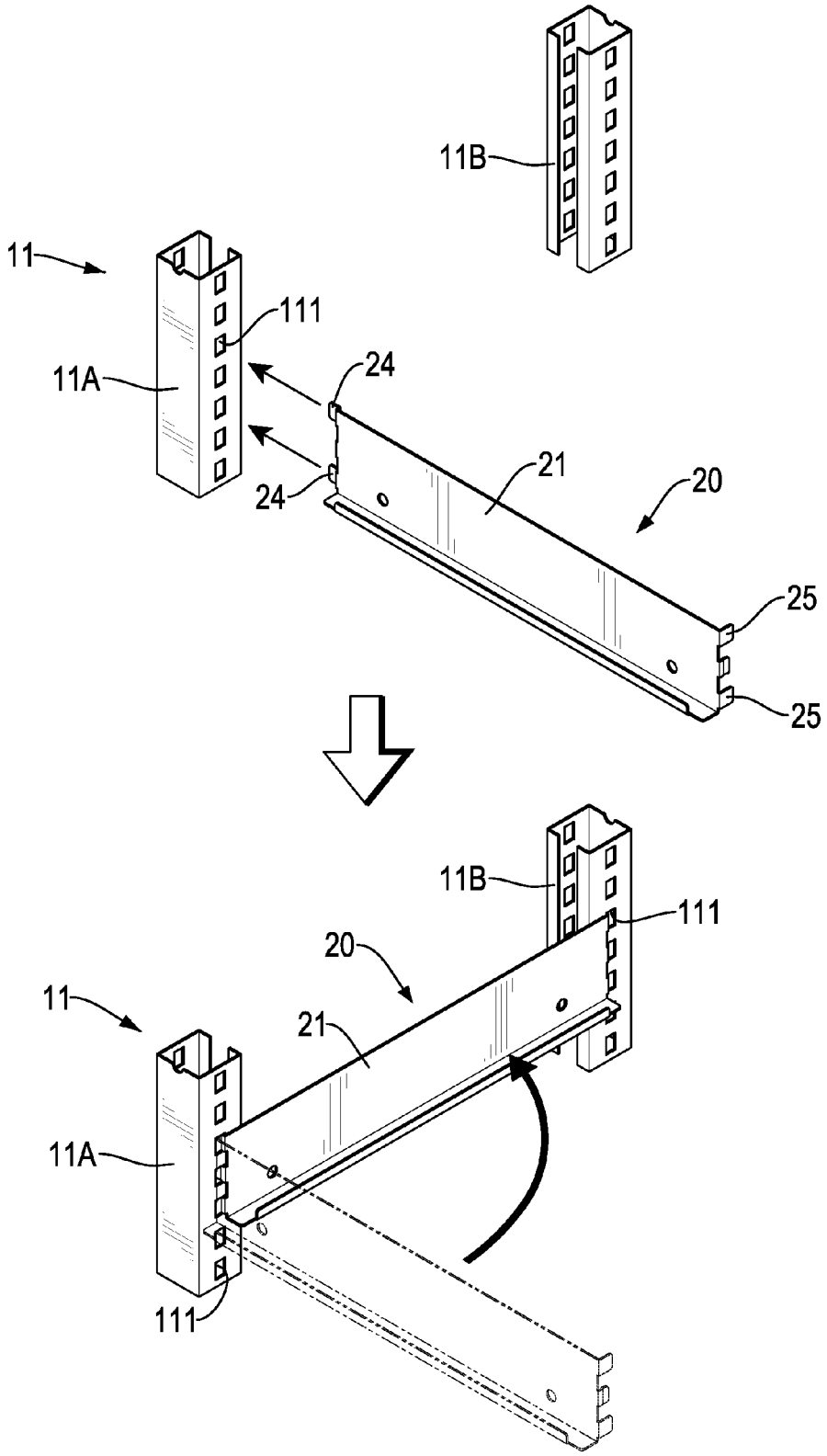
FIG. 5 shows enlarged operational perspective views of a pivotable and positionable rack of the supporting rack assembly in FIG. 1.
Figure 6:
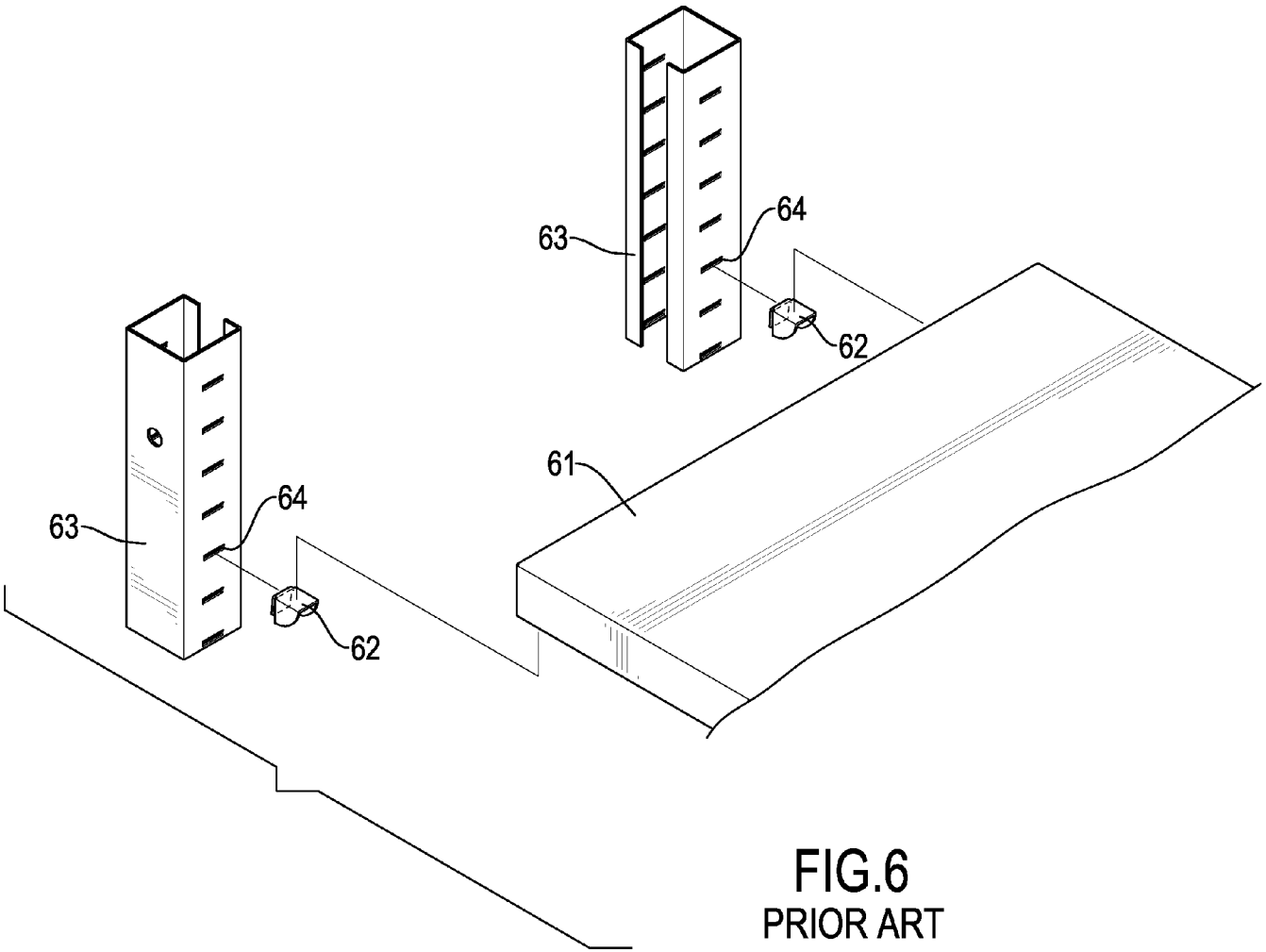
FIG.6 PRIOR ART
FIG. 6 is an exploded perspective view of a conventional rack.

With reference to FIGS. 3 to 5, in assembling, the first inserting plates 24 are first inserted into two of the fixing holes 111 of the frame body 11A. Then, the shelf holder 20 is pivoted relative to the frame body 11A, such that the second inserting plates 25 can move to approach the frame body 11B. Then, the second inserting plates 25 are inserted into two of the fixing holes 111 of the frame body 11B. When the shelf holder 20 is pivoted relative to the frame body 11A, a height of the shelf holder 20 is fixed relative to the frame body 11A since the first inserting plates 24 function as a fulcrum relative to the shelf holder 20. Therefore, the second inserting plates 25 and the first inserting plates 24 are at a same height relative to the pairs of frames 11, such that a vision error during assembling can be avoided.

After the first inserting plates 24 and the second inserting plates 25 are inserted into the fixing holes 111, the protrusions 261 of the engagement plates 26 and the holder body 21 can provide a clamping force to the frame bodies 11A, 11B of the pairs of frames 11. Therefore, the shelf body 20 cannot be detached from the pairs of frames 11 easily. Furthermore, after the shelf holder 20 is pivoted, the first inserting plates 24 can abut the frame body 11A, and then the first inserting plates 24 cannot be detached from the fixing holes 111. The shelf holder 20 can also be mounted on the pairs of frames 11 firmly. The shelf buckles 40 can provide a combining force for the shelf holders 20 and the shelf bodies 30 to keep the shelf bodies 30 from being detached from the shelf holders 20 after assembling.

From the above description, it is noted that the present invention has the following advantages:

1. The first inserting plates 24 are first inserted into the frame body 11A, and then the shelf holder 20 is pivoted relative to the pair of frames 11 to insert the second inserting plates 25 into the frame body 11B. Therefore, the height of the shelf holder 20 can be fixed, such that an assembling error due to the vision error can be avoided.

2. The extension directions of the first inserting plates 24 and the second inserting plates 25 are different, so after the shelf holder 20 is pivoted, the first inserting plates 24 can abut the frame body 11A. Therefore, the shelf holders 20 cannot be detached from the pairs of frames 11 easily.

3. The shelf buckles 40 can strengthen the combination between the shelf holders 20 and the shelf bodies 30.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A supporting rack assembly having:

a frame module having two pairs of frames spaced from each other at an interval, and each pair of frames having two frame bodies, wherein each frame body has a longitudinal direction; and multiple fixing holes formed through the frame body and arranged along the longitudinal direction of the frame body;

multiple pairs of shelf holders mounted on the pairs of frames and arranged longitudinally, and each shelf holder of each pair of shelf holders having a holder body being elongated and having a bottom;

a supporting portion connected with the bottom of the holder body, wherein a junction between the holder body and the supporting portion is bent;

two first inserting plates connected with an end of the holder body and respectively inserted into two of the fixing holes of one of the frame bodies of a corresponding one of the pairs of frames, and each first inserting plate having an extension direction, wherein the extension directions of the first inserting plates are same with an extension direction of the holder body;

two second inserting plates connected with another end of the holder body at a position opposite to the first inserting plates, and respectively inserted into two of the fixing holes of the other frame body of the corresponding pair of frames of the frame module, and each second inserting plate having an extension direction, wherein the extension directions of the second inserting plates are different from the extension direction of the holder body; and two engagement plates respectively connected with the two ends of the holder body, respectively inserted into the fixing holes of the frame bodies of the corresponding pair of frames, wherein two junctions between the engagement plates and the holder body are bent, each engagement plate having a protrusion formed thereon, and the protrusions of the engagement plates extending toward each other, wherein each protrusion and the holder body are respectively located at two opposite sides of the frame body; and multiple shelf bodies respectively mounted on the supporting portions of the pairs of shelf holders.

2. The supporting rack assembly as claimed in claim 1, wherein the extension directions of the second inserting plates are perpendicular to the extension direction of the holder body.

3. The supporting rack assembly as claimed in claim 2, wherein the frame module further has two supporting beams respectively mounted in the pairs of frames, and each supporting beam is supported between the frame bodies of a corresponding one of the pairs of frames.

4. The supporting rack assembly as claimed in claim 1 further having multiple shelf buckles buckled on the holder bodies of the shelf holders and the shelf bodies.

5. The supporting rack assembly as claimed in claim 2 further having multiple shelf buckles buckled on the holder bodies of the shelf holders and the shelf bodies.

6. The supporting rack assembly as claimed in claim 3 further having multiple shelf buckles buckled on the holder bodies of the shelf holders and the shelf bodies.

* * * * *